US005269158A

United States Patent [19]

Bitter et al.

[11] Patent Number: 5,269,158

[45] Date of Patent: Dec. 14, 1993

[54] EVAPORATOR FOR A COMPRESSOR-REFRIGERATING APPARATUS

[75] Inventors: Dieter Bitter, Finnentrop; Eberhard Bornkessel, Sundern; Helmut Gehrke, Lüdenscheid; Herbert Stember, Werdohl; Horst Schnabel, Neuenrade, all of Fed. Rep. of Germany

[73] Assignee: Krupp VDM GmbH, Werdohl, Fed. Rep. of Germany

[21] Appl. No.: 900,146

[22] Filed: Jun. 17, 1992

[30] Foreign Application Priority Data

Jun. 22, 1991 [DE] Fed. Rep. of Germany ..... 4120651

[51] Int. Cl.[5] ..... F25B 41/06

[52] U.S. Cl. ..... 62/511; 62/515

[58] Field of Search ..... 62/511, 515

[56] References Cited

U.S. PATENT DOCUMENTS

| | | | |
|---|---|---|---|
| 2,760,346 | 8/1956 | Grenell et al. . | |
| 2,776,550 | 1/1957 | Magester . | |
| 2,956,421 | 10/1960 | Stevens | 62/511 |
| 2,959,027 | 11/1960 | Ewing | 62/515 |
| 2,979,924 | 4/1961 | Balogh | 62/511 |
| 3,172,272 | 3/1965 | Alsing | 62/511 |
| 4,086,782 | 5/1978 | Forsberg | 62/515 |
| 4,449,853 | 5/1984 | Mennella et al. . | |
| 4,715,187 | 12/1987 | Stearns | 62/511 |

FOREIGN PATENT DOCUMENTS 1242646 6/1967 Fed. Rep. of Germany .

*Primary Examiner*—Ronald C. Capossela

*Attorney, Agent, or Firm*—Meltzer, Lippe, Goldstein, Wolf, Schlissel & Sazer

[57] ABSTRACT

The characterizing features of the invention are that a guide tube is provided which is disposed at least partially outside the evaporator plate and partially in the suction tube, is directly or indirectly retained on the evaporator and has a somewhat larger internal diameter than the external diameter of the throttle/capillary tube and a substantially smaller external diameter than that of the internal diameter of the suction tube; the throttle/capillary tube is inserted in the guide tube from outside and the compressor side end zone of the internal generated surface of the guide tube is connected pressure-tight inside a first longitudinal portion of the coolant supply line disposed in the guide tube to the associated zone of the external generated surface of the throttle/capillary tube and terminates in the guide tube; and the guide tube forms a second longitudinal portion of the coolant supply line having a cross-section widened in comparison with the capillary flow cross-section, and the inside space of the guide tube determined by the widened second longitudinal portion is connected to the inlet zone of the coolant duct.

9 Claims, 3 Drawing Sheets

EVAPORATOR FOR A COMPRESSOR-REFRIGERATING APPARATUS

Figure 1:
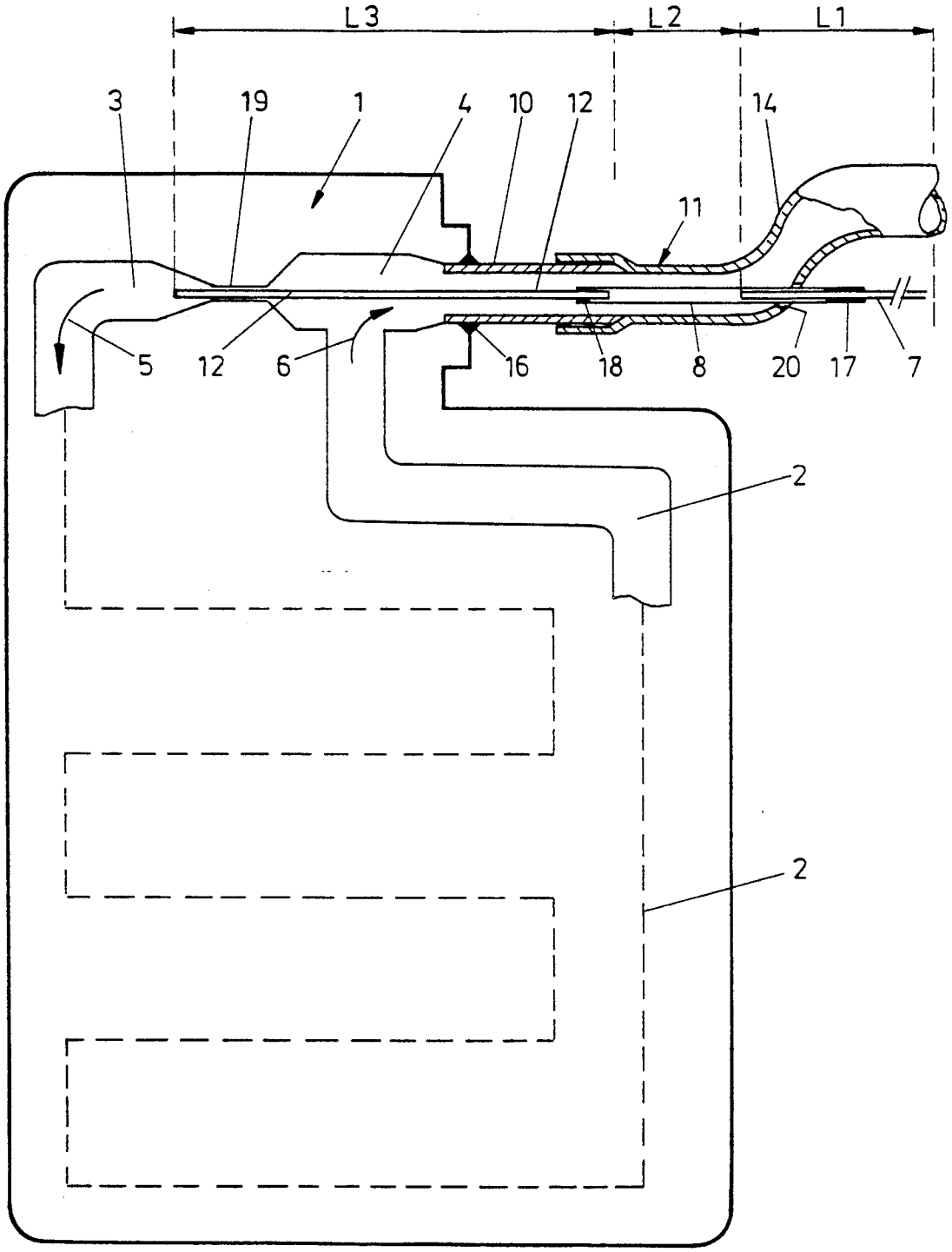

The invention relates to an evaporator for a compressor-refrigerating apparatus, wherein the evaporator, produced from a two-layer evaporator plate, has a coolant duct which extends meander-fashion between the layers and into whose inlet zone a small diameter coolant supply line acting as a throttle and connectable to the pressure side of the compressor disposed in the coolant circuit discharges, and whose outlet zone terminates in a suction tube of larger diameter which can be connected to the suction side of the compressor, a longitudinal portion of the coolant supply line being disposed inside the outlet zone and inside the suction tube thereof, whose wall pierces the coolant supply line, the coolant supply line also being constructed over a substantial proportion of its length in the form of a throttle/capillary tube of capillary flow cross-section. Similarly constructed evaporators are known, for example, from DE-AS 12 42 646 and many of them are used in domestic refrigerators.

As regards the coolant circuit, the invention relates more particularly to the coolant inlet into the evaporator, which in the known cooling apparatuses is effected via a throttle/capillary tube which corresponds in length to the required throttling effect and which is the coolant supply line in the practised state of art. As a rule the throttle/capillary tube extends through a corresponding inlet connection into the inlet zone of the coolant and in the case of the so-called single tube connection also lies by a portion of its length in the outlet zone of the coolant duct. The coolant duct itself extends meander-fashion in an evaporator plate which is produced, for example, by the so-called rollbond process from two sheets of aluminium welded to one another and is originally flat, and then shaped into the refrigerating compartment and which terminates on the outlet side in an aluminium spigot, the so-called suction tube, inserted pressure-tight into the end of the duct.

Nowadays in the majority of kinds of refrigerator constructed the throttle/capillary tube is so long that it can be accommodated only to a small extent in the inlet zone of the evaporator coolant duct and mainly lies, frequently by a component length of several meters, outside the evaporator. As a rule this component length is wound after the fashion of an annular collar to form a so-called capillary curl.

With the recent introduction of novel coolants which have different material properties from the previous ones, but which also show their own transitional behaviour from the liquid to the gaseous phase in the coolant circuits, the throttling distance had to be lengthened for the same internal diameter of the capillary tube, so that the capillary curl became even larger.

A first simplification of production was achieved merely by using for evaporators of different types throttle/capillary tubes which all have an external diameter of, for example, 1.9 mm and which with internal diameters of, for example, 0.55 to 1.05 mm allow adaptation to various types of evaporator. For example, at least connections of the throttle/capillary tube or openings therefor can be of uniform construction. However, involving the capillary curl in the final steps of production still represents an obstacle, just as the capillary curl has an unfavourable effect on the packing density of the evaporators during their transportation to the refrigerator manufacturers.

It is an object of the invention to simplify the variety in the production of the evaporators caused by the numerous types of refrigerator, thereby allowing for the consequences of the use of novel coolants of lower viscosity.

According to the invention, therefore, a guide tube is provided which is disposed at least partially outside the evaporator plate and partially in the suction tube, is directly or indirectly retained on the evaporator and has a somewhat larger internal diameter than the external diameter of the throttle/capillary tube and a substantially smaller external diameter than that of the internal diameter of the suction tube, The throttle/capillary tube is inserted in the guide tube from outside and the compressor side end zone of the internal generated surface of the guide tube is connected pressure-tight inside a first longitudinal portion of the coolant supply line disposed in the guide tube to the associated zone of the external generated surface of the throttle/capillary tube and terminates in the guide tube, and the guide tube forms a second longitudinal portion of the coolant supply line having a cross-section widened in comparison with the capillary flow cross-section, and the inside space of the guide tube determined by the widened second longitudinal portion is connected to the inlet zone of the coolant duct.

As a rule a soldering gap fit is left between the throttle/capillary tube and the guide tube, the tubes being connected by the filling of the gap during soldering.

The invention makes possible a far-reaching standardization of evaporator manufacture and basically allows the separate production of the evaporators, still free from the throttle/capillary tube, and of the associated capillary tubes until a final assembly in which the capillary tube is incorporated in the guide tube—i.e., is inserted thereinto or therethrough as far as desired and finally is soldered thereto. The length, nature and incorporation of the guide tubes in the evaporator plates can be reduced to a small number of constructional variants, thereby simplifying the course of manufacture.

Another feature of the invention is set forth in claim 2, according to which the guide tube is fitted with a soldering gap fit on the evaporator side on to a further capillary tube and is connected pressure-tight thereto, the further capillary tube forming the connection between the inside space of the second longitudinal portion to the inlet zone and a third longitudinal portion of the coolant supply line which is the last portion on the evaporator side. According to claim 3 the throttle/capillary forms the further capillary tube which terminates adjacent its wall penetration in the guide tube attached to the evaporator and into whose other side the throttle/capillary tube is inserted. The production of the connection can be the last production step of the evaporator manufacturer or a production step by the refrigerating apparatus constructor.

It is important for the standardization of evaporator production that the same internal diameter can be selected for the further capillary tube in all evaporators of a range of types, so that the necessary adaptation can be carried out with variable internal diameters of the throttle/capillary tube depending on the individual types.

If the guide tube is made somewhat longer and introduced from outside (claim 4) into the coolant duct as far as the inlet zone thereof, the result can be a coolant supply line having a total of two longitudinal portions of different internal diameter. It is immaterial that the after all relatively short last portion of the coolant supply line can produce only a slight throttling effect, because on the other hand it enables the coolant to be introduced into the coolant duct in a manner favourable to the flow.

Very many of the present day conventional evaporators of refrigerating apparatuses have, as shown, for example, in German Utility Model No. 74 31 690, a single tube connection, namely in the case of evaporators in which the inlet and outlet tubes partially lie one inside the other. The construction of the invention as set forth in claim 5 relates to evaporators having a specially designed single tube connection, wherein an aluminium suction tube and an intermediate bent copper tube adjoining the suction tube in its central zone are provided, and the intermediate zone has in the bend and substantially in the prolongation of the suction tube axis a wall aperture for the coolant supply line disposed partially in the intermediate tube, partially in the suction tube and partially in a portion of the cooling duct. According to the invention the copper guide tube is inserted in the wall aperture of the intermediate tube and is at that place tightly welded or soldered to the intermediate tube wall.

It should be pointed out that in evaporators frequently an intermediate copper tube bent in S-shape in its central zone is welded or soldered to the straight suction tube, the wall aperture being in this case provided in the first bend on the suction tube side and again lying substantially in the prolongation of the suction tube axis.

In the feature of the invention set forth in claim 6 a portion of the guide tube disposed in the coolant duct is longer than a portion of the capillary tube disposed in the coolant duct. This again leads to the aforementioned advantageous design of the inner outflow conditions.

In the feature of the invention set forth in claim 7 the guide tube has a narrowed portion as an internal stop for fixing the evaporator side end of the throttle/capillary tube. Accordingly (claim 8), viewed in the inflow direction the narrowed portion lies downstream of the aperture of the intermediate tube and therefore inside the zone formed by the intermediate tube, the suction tube and the coolant duct.

Conveniently (claim 9) the outer end of the guide tube, into which the throttle/capillary tube is inserted during production, is widened to form a funnel. This also facilitates soldering.

As a whole the invention allows problem-free adaptation to the different constructional requirements of refrigerating apparatus manufactures.

Embodiments of the invention will now be explained.

Figure 2:
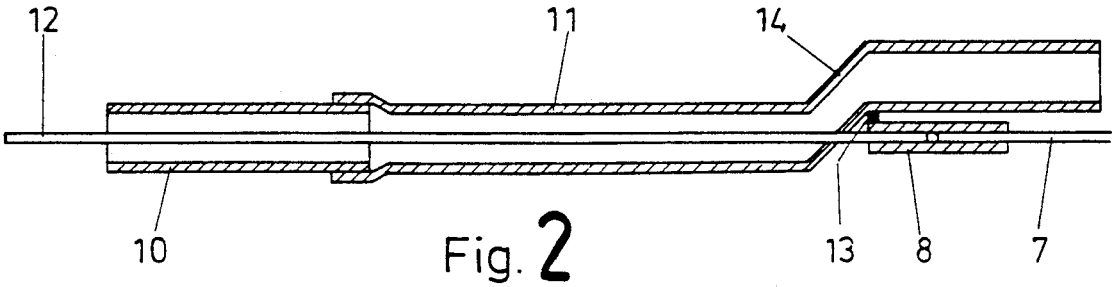
Figure 3:
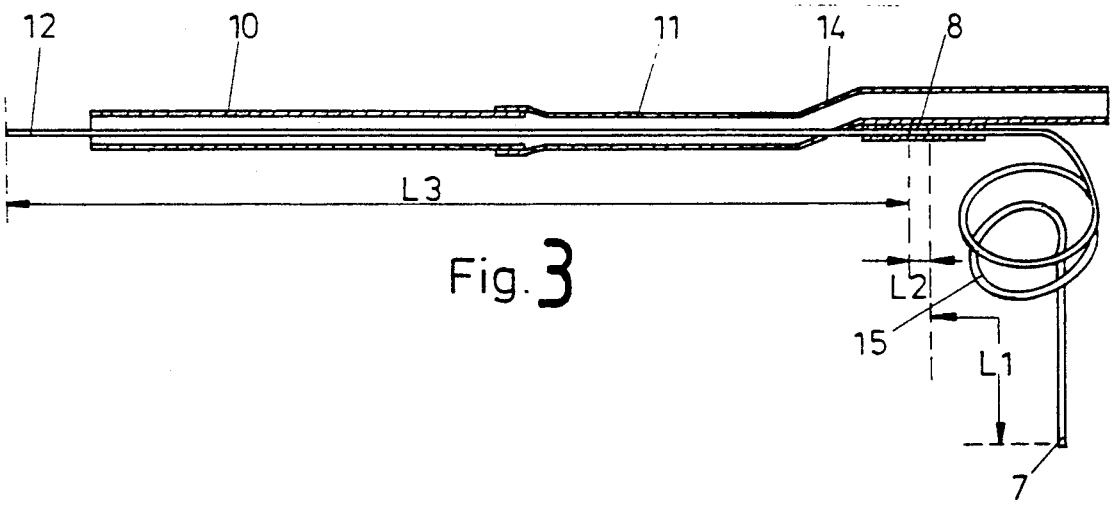
Figure 4:
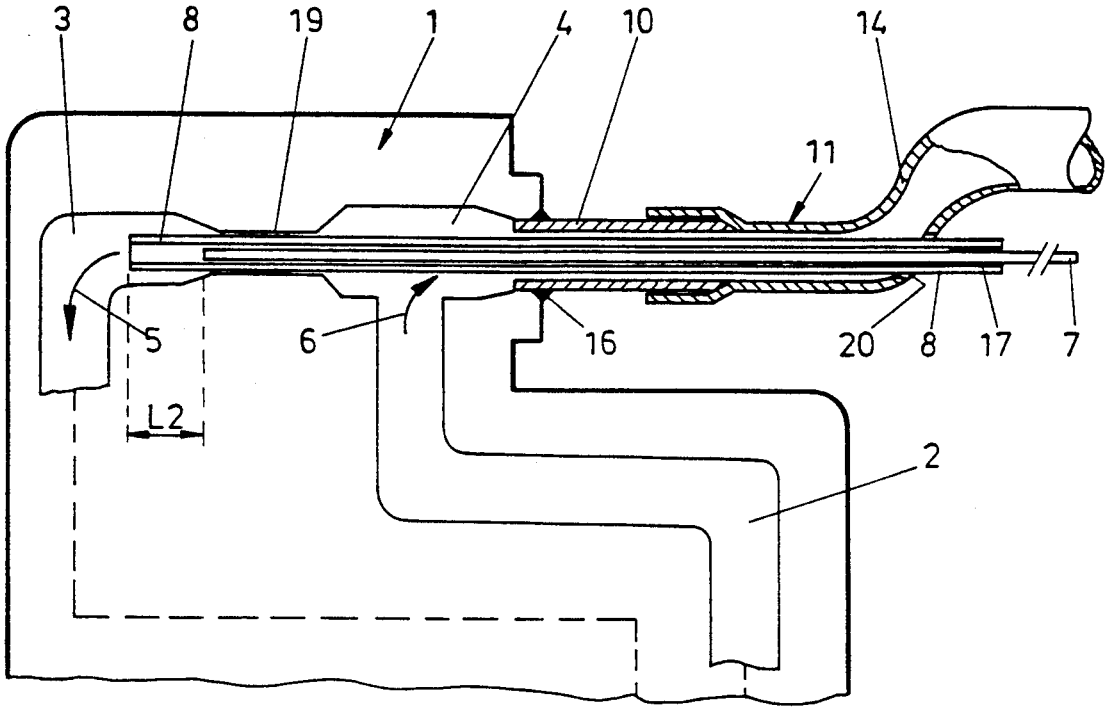
Figure 5:
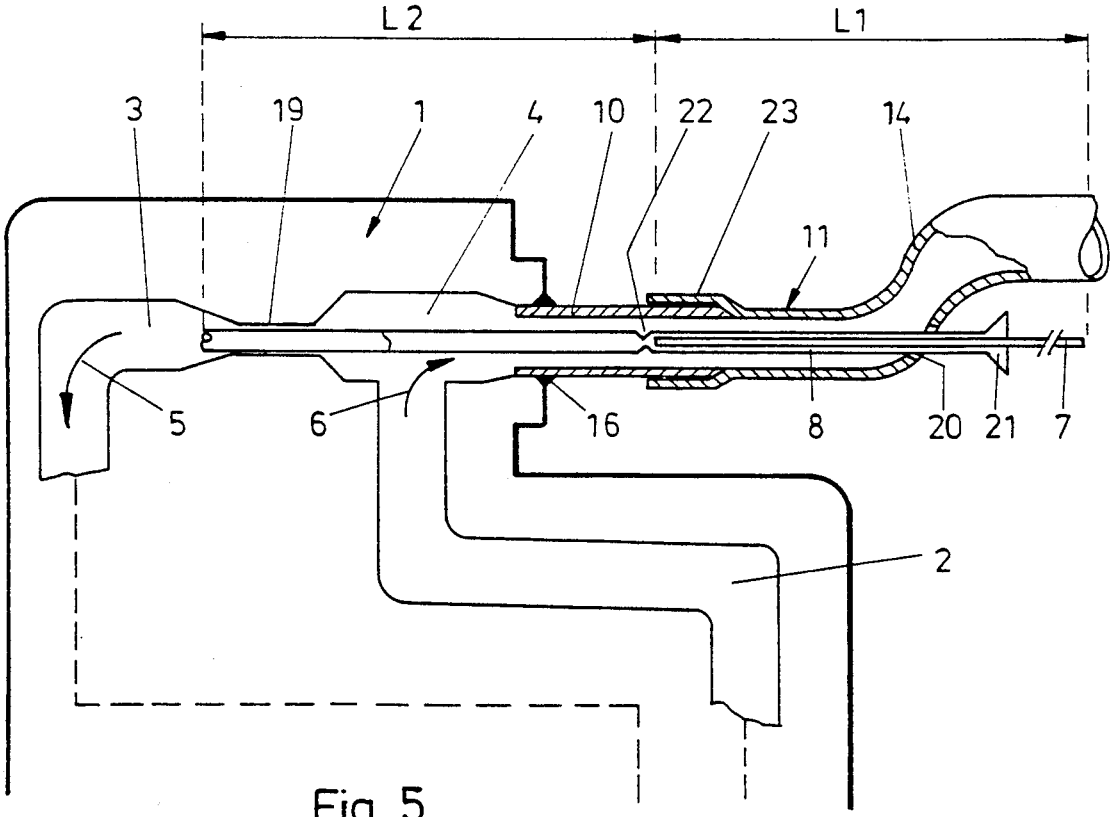

The drawings show diagrammatically and partially or completely sectioned:

FIG. 1 a refrigerating apparatus evaporator having a single tube connection, FIG. 2 a single tube connection for an evaporator, FIG. 3 another single tube connection for an evaporator, FIG. 4 a construction of the single tube connection of a refrigerating apparatus evaporator, and FIG. 5 another construction of a single tube connection.

According to FIG. 1 an evaporator plate 1 is built by two aluminium sheets lying on top of each other and being connected up to the channel width. A coolant duct 2 is formed in the evaporator plate 1 having an inlet zone 3 and an outlet zone 4. An arrow 5 shows the direction of flow in the inlet zone 3 and a further arrow 6 indicates the flow in the outlet zone 4.

The inlet zone 3 of the coolant duct 2 is supplied via a throttle/capillary tube 7 which is normally of copper and which is inserted in a copper guide tube 8 connected via a Cu/Al solder to an aluminium inlet tube 9 and retained thereby indirectly by the evaporator plate 1. Although the evaporators of cooling apparatuses are as a rule shaped into a refrigerating compartment, FIG. 1 shows a flat evaporator whose coolant duct 2 is partially indicated by a chain line. The guide pipe 8 being partially disposed in the intermediate tube 11 extends in an S-shaped bend 14 through the wall of the intermediate tube 11 and terminates in the suction tube 10, which is retained in the evaporator plate via a soldered connection 16.

A soldering place 17 retains the throttle/capillary tube 17 and a further soldering place 18 retains the further capillary tube 12 in the guide tube 8. Except for a narrowed place 19 separating the inlet zone 3 and the outlet zone 4, the further capillary tube 12 extends in the duct system. The narrowed place 19 forms the inner fixing for the coolant supply line, while the other fixing takes place in an opening 20 in the wall of the intermediate tube 11 to which the guide tube 8 is soldered.

Acting as the coolant outlet is a suction tube 10 of substantially larger internal diameter than that of the inlet tube 9.

FIGS. 2 and 3 show so-called single-tube connections which, apart from the insertion of the throttle/capillary tube 7, are produced thus and incorporated in an evaporator plate.

In single tube connections an aluminium suction tube 10 is connected to a soldered-on intermediate copper tube 11. Disposed in the suction tube 10 and the intermediate tube 11 is a further capillary tube 12 which extends outwards through the wall of the intermediate tube in a curve 14 (in this case substantially S-shaped) thereof and is inserted in the evaporator side end of the guide tube 8. The guide tube 8 is retained on the intermediate tube 11 by means of an element 13.

The throttle/capillary tube 7 is inserted at a distance from the further capillary tube 12 into the other end of the guide tube 8. The throttle/capillary tube 7 and the further throttle/capillary tube 12 are connected to the guide tube 8 by welding. During welding suitable steps must be taken to ensure that the capillaries are not accidentally closed with solder.

In evaporator production, first the suction tube connections (FIGS. 2 and 3) are made, but as yet without the throttle/capillary tube 7, and are then attached to the evaporator plate 1. The throttle/capillary tube 7 is incorporated only when the rest of the evaporator is ready.

The constructional unit shown without throttle/capillary tube is a standard suction tube connection which can be used for many types of evaporator and in which the further capillary tube 12 has, for example, an internal diameter of 1.1 mm. This standard suction tube connection is then completed with the most various throttle/capillary tubes 7, corresponding solely in external diameter to the further capillary tube 12, namely with throttle/capillary tubes 7 of various internal diameters and different lengths.

FIG. 3 shows a capillary curl 15 which illustrates how particularly long capillary tubes 7 are compressed spatially. FIG. 3 also shows how in this case the coolant supply line is made up of a large length portion L1, the second longitudinal portion L2, a short zone in the guide tube 8, and the third longitudinal portion of the further capillary tube 12.

The constructions illustrated in FIGS. 4 and 5 are basically simpler, the guide tube 8 itself extending to the narrowed place 19 and therebeyond into the inlet zone 3.

As shown in FIG. 4 both the throttle/capillary tube 7 and also the guide tube 8 lie partially in the inlet zone 3 of the coolant duct 2; however, the corresponding portion of the throttle/capillary tube 7 is shorter than the corresponding portion of the guide tube 8. In this case the difference forms the second longitudinal portion L2 of the coolant supply line.

As shown in FIG. 5 the outer end of the guide tube 8 is widened to form a funnel 21 and the guide tube 8 also has a narrowed portion 22 acting as an inner stop for the throttle/capillary tube 7.

FIG. 5 shows a flare 23 at the evaporator side end of the intermediate tube 11 into which the suction pipe is inserted with a soldered fit. A particularly reliable Cu/Al soldered connection can be produced in this way.

We claim:

1. An evaporator for a compressor-refrigerating apparatus, comprising an evaporator plate having first and second layers, a coolant duct which extends between said first and second layers, said coolant duct having an inlet zone and an outlet zone, a coolant supply line connected to a pressure side of a compressor which passes through said suction tube and said outlet zone of said coolant duct to deliver coolant into said inlet zone of said coolant duct, a suction tube connected to a suction side of said compressor which receives coolant from said outlet zone of said coolant duct, said coolant supply line including a first longitudinal portion in the form of a throttle/capillary tube of capillary flow cross-section, and a guide tube diposed at least partially outside said evaporator plate and partially within said suction tube, and being retained on said evaporator plate, said guide tube having an internal diameter which is larger than an external diameter of said throttle/-capillary tube, and an external diameter which is smaller than an internal diameter of said suction tube, said guide tube having a compressor-side end zone and an evaporator-side end zone, said throttle/capillary tube being inserted pressure-tight into said compressor-side end zone of said guide tube and terminating inside said guide tube, said guide tube forming a second longitudinal portion of said coolant supply line having a cross-section which is wider than said capillary flow cross-section of said throttle/capillary tube, said evaporator-side end zone of said guide tube being connected to said inlet zone of said coolant duct to deliver coolant therein.

2. The evaporator of claim 1 further comprising a second capillary tube which is inserted pressure-tight into said evaporator side end zone of said guide tube, said second capillary tube connecting said evaporator-side end zone of said guide tube to said inlet zone of said coolant duct and constituting a third longitudinal portion of said coolant supply line.

3. The evaporator of claim 1 wherein said throttle/-capillary tube extends pressure-tight through a wall of said suction tube as far as said inlet zone of coolant duct.

4. The evaporator of claim 1 wherein said guide tube extends as far as said inlet zone of said coolant duct.

5. The evaporator of claim 4 further comprising an intermediate tube having a bend therein connected to said suction tube, said suction tube being made from aluminum, said intermediate tube and said guide tube being made from copper, said intermediate tube including a wall aperture through which said guide tube is inserted into said intermediate tube and welded thereto.

6. The evaporator of claim 4 wherein a portion of said guide tube disposed in said coolant duct is longer than a portion of said throttle/capillary tube disposed in said coolant duct.

7. The evaporator of claim 5 wherein said guide tube has a narrowed portion as a stop for an evaporator side end of said throttle/capillary tube.

8. The evaporator of claim 7 wherein said narrowed portion is located downstream of said wall aperture.

9. The evaporator of claim 1 wherein an end of said guide tube is widened to form a funnel.

* * * * *